US007731597B1

(12) United States Patent
Burgess

(10) Patent No.: US 7,731,597 B1
(45) Date of Patent: Jun. 8, 2010

(54) GOLF TRAINING DEVICE

(76) Inventor: Stephen D. Burgess, 4339 Sexton, Dallas, TX (US) 75229

( * ) Notice: Subject to any disclaimer, the term of this patent is extended or adjusted under 35 U.S.C. 154(b) by 22 days.

(21) Appl. No.: 12/341,369

(22) Filed: Dec. 22, 2008

(51) Int. Cl.
*A63B 69/36* (2006.01)
*A63B 21/02* (2006.01)

(52) U.S. Cl. ..... 473/215; 473/213; 482/124

(58) Field of Classification Search ..... 473/207, 473/212, 213, 214, 215, 216, 217, 219, 223, 473/422, 458; 482/124, 126
See application file for complete search history.

(56) References Cited

U.S. PATENT DOCUMENTS 5,188,365 A * 2/1993 Picard ..... 473/213
5,704,856 A * 1/1998 Morse ..... 473/422
7,314,437 B2 * 1/2008 Frappier ..... 482/124
7,632,192 B2 * 12/2009 Begert ..... 473/216

* cited by examiner

*Primary Examiner*—Nini Legesse
(74) *Attorney, Agent, or Firm*—Carstens & Cahoon LLP

(57) ABSTRACT

The present invention provides a sport training device for improving technique by providing resistance within the context of a sporting movement. The invention comprises an arcuate frame worn on the thigh of a user, which is secure to the user's thigh with an adjustable belt or cuff coupled to the frame. A lever coupled to the frame extends away from the frame in front of the user's body and an elastic cord is anchored to the lever. An attachment means is coupled to the other end of the elastic cord to allow the user's arms to extend the cord, thereby providing resistance to the user's movement. The attachment means attaches the cord to a wrist strap or glove worn by the user or to the handle of a sport implement such as a golf club.

10 Claims, 10 Drawing Sheets

GOLF TRAINING DEVICE

TECHNICAL FIELD

The present invention relates general to sports training equipment and more specifically to an apparatus that provided resistance to muscles within the biomechanical context of a golf swing, thereby improving both specific strength and technique.

BACKGROUND OF THE INVENTION

In recent years, golf has enjoyed increasing popularity among the general public. Unfortunately, a proper golf swing is one of the most difficult sports movements to master. Part of the difficulty in mastering a golf swing comes from strength deficiencies and lack of coordination between the involved muscle groups. The golf swing is a full body movement that requires the coordinated integration of upper body and lower body movements, with the abdominal and lower back muscles (a.k.a. the core) acting to transmit power between the upper and lower body while stabilizing the spine.

FIG. 1 illustrates the planes of motion of the human body. The movement pattern of a golf swing occurs primarily in the transverse (a.k.a. axial) plane of movement, which tends to be a weak plane of movement even for relatively strong individuals because most conventional strength exercises occur in the sagittal plane and to a lesser extent in the frontal plane. While many, if not most natural movements do have a transverse plane component to them, these movements are rarely performed under conditions of load and power similar to that of a golf swing. Even explosive athletic movements with a significant transverse plane component such as throwing a ball or swinging a tennis racquet are performed against relative light resistance and use implements that have much shorter lever arms than a golf club, requiring the generation of less torque. Therefore, not only do the necessary muscles have to be properly strengthened, they must also be able to produce force in a coordinated way within the transverse plane.

Therefore, it would be desirable to have an apparatus that not only helps to strengthen the muscles used in a golf swing but does so in a manner that reinforces proper golf swing technique

SUMMARY OF THE INVENTION

The present invention provides a sport training device for improving technique by providing resistance within the context of a sporting movement. The invention comprises an arcuate frame worn on the thigh of a user, which is secure to the user's thigh with an adjustable belt or cuff coupled to the frame. A lever coupled to the frame extends away from the frame in front of the user's body and an elastic cord is anchored to the lever. An attachment means is coupled to the other end of the elastic cord to allow the user's arms to extend the cord, thereby providing resistance to the user's movement. The attachment means can attach the cord to a wrist strap or glove worn by the user or it can attach the cord to the handle of a sport implement such as a golf club. In the preferred embodiment, the lever rotates on a hinge and locks in an extended position when the cord is pulled across the body.

When the user pulls his arms back, such as during a golf backswing, the elastic cord pulls the lever into the extended position where a lever stop prevents further rotation of the lever. Continued movement of the arm will cause the elastic cord to stretch, providing resistance against the movement.

The resistance increases the load against the muscles involved in the movement, both increasing their strength within the context of the movement and reinforcing proper posture and stabilization, leading to more efficient technique.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWINGS

Figure 1:
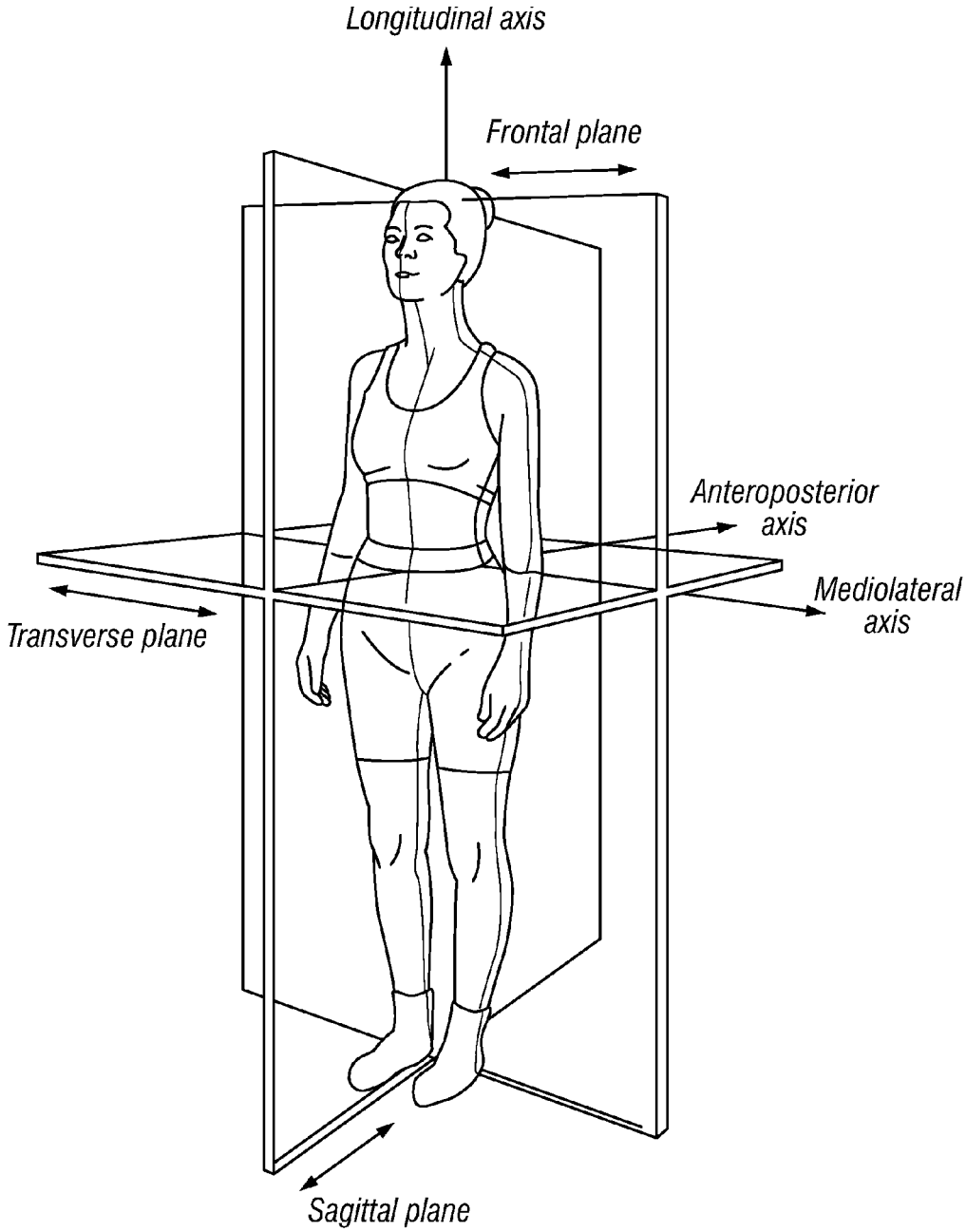
FIG. 1 illustrates the planes of motion of the human body.
Figure 2A:
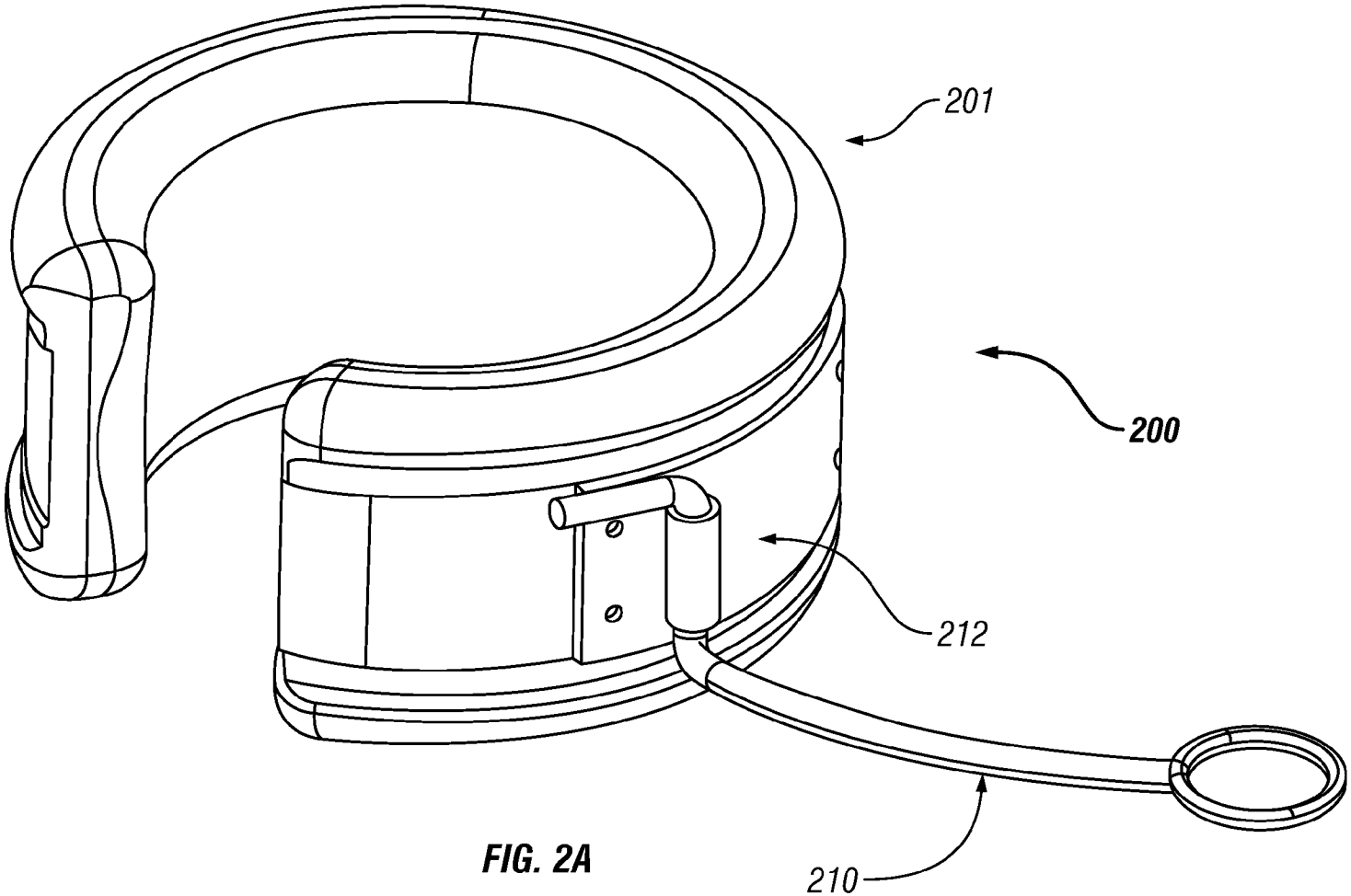
FIG. 2A is a perspective view of the golf training device in accordance with a preferred embodiment of the present invention.

FIG. 2A is a perspective view of the golf training device in accordance with a preferred embodiment of the present invention. The device 200 comprises a base frame 201 that is curved to fit over the thigh of the user. This frame is coupled to an adjustable belt or cuff (not shown) that is used to properly adjust and secure the device to the user's thigh. A lever 210 is mounted on the frame 201 at a hinge 212. The frame 201, hinge 212, and lever 210 of the golf training device can be made from metal or high-strength plastics.

Figure 2B:
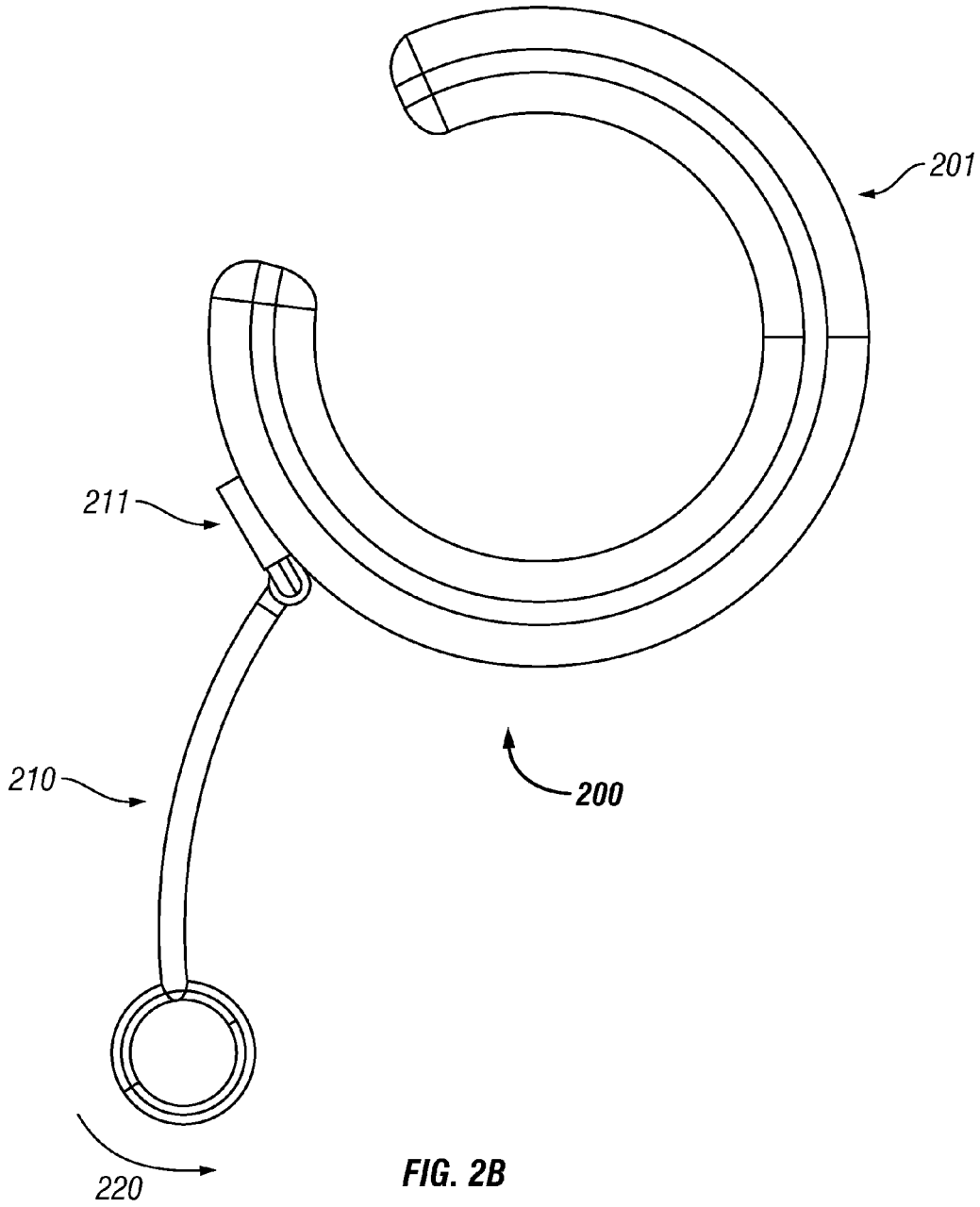
FIG. 2B is a top plan view of the golf training device.

FIG. 2B is a top plan view of the golf training device. In the present example, the lever 210 is collapsible against the frame 201 as indicated by arrow 220. When in the fully extended position the lever 210 is prevented from further movement by the lever stop 211, which rests against the frame 201 and prevents further rotation of the lever.

Attached to the distal end of the lever 210 is an elastic cord (not shown), which can be made from surgical tubing, bungee cord or similar elastic material. In the example shown in FIGS. 2A and 2B, the elastic cord is tied around the ring at the end of the lever 210.

Figure 3A:
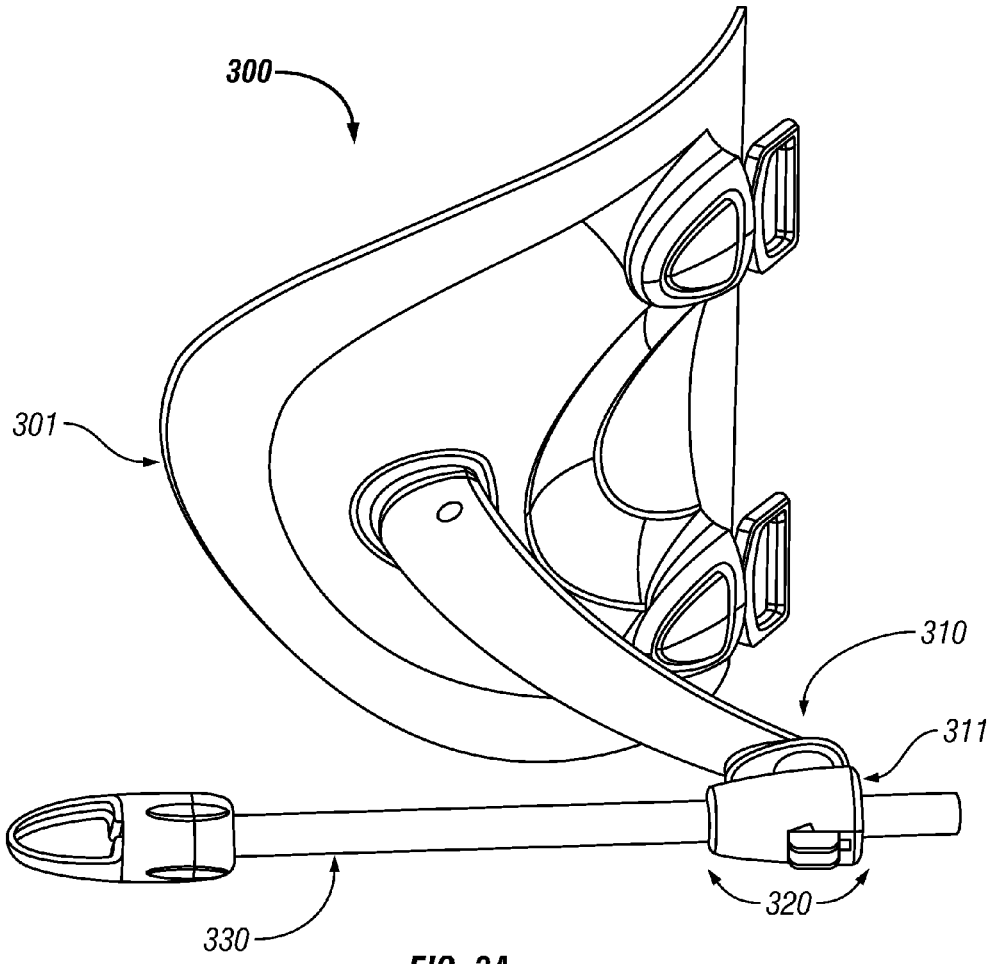
FIG. 3A is a perspective view of the golf trainer in accordance with an alternate embodiment of the present invention.
Figure 3B:
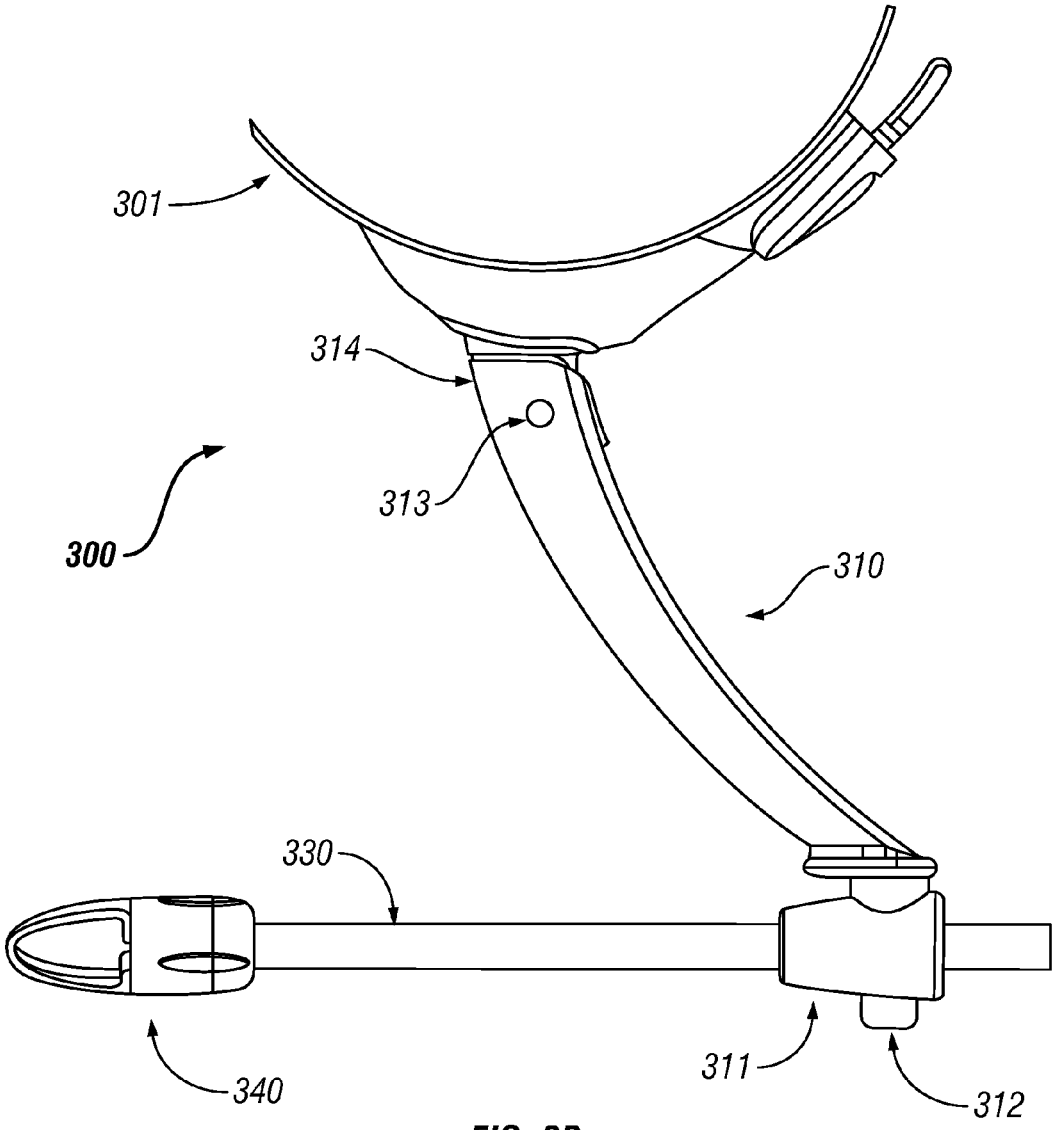
FIG. 3B is a top plan view of the alternate embodiment.

FIG. 3A is a perspective view of the golf trainer in accordance with an alternate embodiment of the present invention. FIG. 3B is a top plan view of the alternate embodiment. This alternate embodiment is functionally equivalent to the embodiment shown in FIG. 2, but with minor design differences. The frame 301 in this embodiment has a shorter arc and does not wrap around the thigh of the user as much as the previous embodiment. In addition, the elastic cord 330 is fed through a pivoting head 311 at the distal end of the level 310. The lever head 311 pivots around axis 312 as indicated by arrow 320 in FIG. 3A. As in the previous embodiment, the lever 310 can fold against the frame 301 by pivoting around hinge 313. This allows for ease of storage. In this embodiment, the proximal end 314 of the lever extends beyond the pivot point 313 and acts as a natural stop that limits the outward extension of the lever 310 to a roughly perpendicular position relative to the user's thigh.

To produce resistance during the backswing, the distal end 340 of the elastic cord 330 is anchored near the base of the golf club. In one embodiment, the elastic cord is attached to a wrist strap or glove worn by the user. In another embodiment, the cord is attached directly to the golf club handle.

Figure 4:
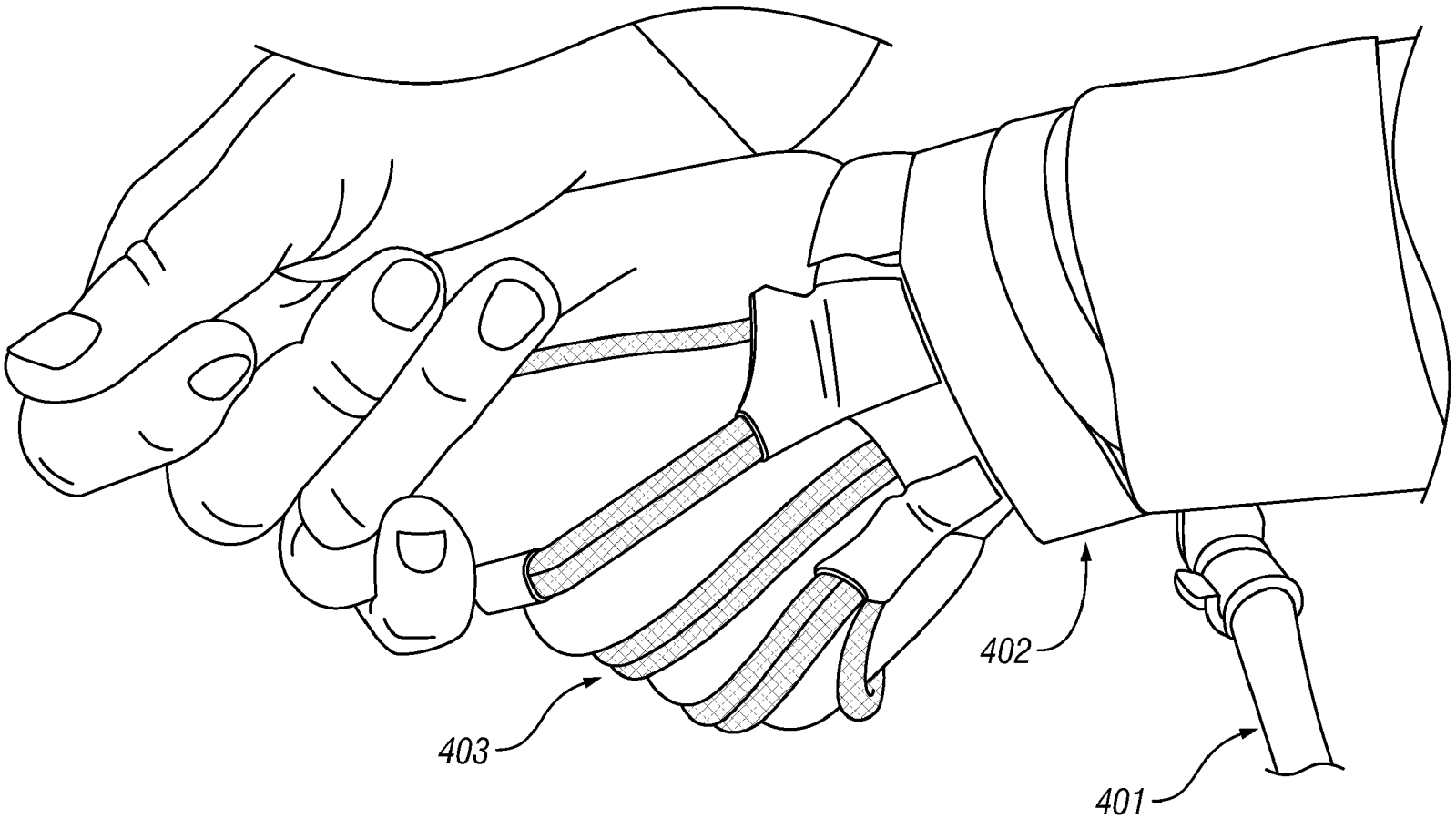
FIG. 4 shows a specialized wrist strap for attaching the distal end of the elastic resistance cord in accordance with the present invention.

FIG. 4 shows a specialized wrist strap for attaching the distal end of the elastic resistance cord in accordance with the present invention. In this embodiment, the elastic cord 401 is attached to a strap 402 that is secured around the wrist. The wrist strap 402 in turn has elastic loops 403 that hook over the fingers to provide additional support to the hand during loading.

Figure 5A:
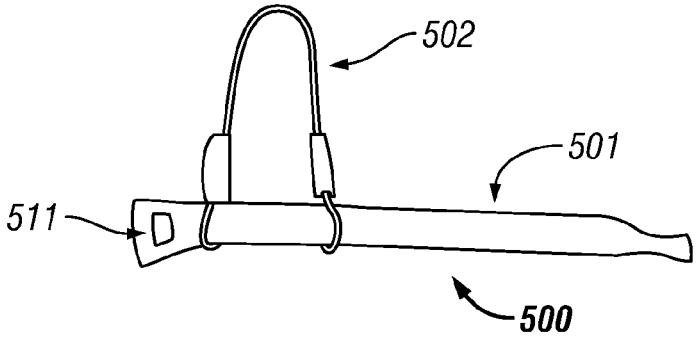
FIGS. 5A-5C show an attachment device for securing the elastic cord to the handle of a golf club in accordance with the present invention.
Figure 5B:
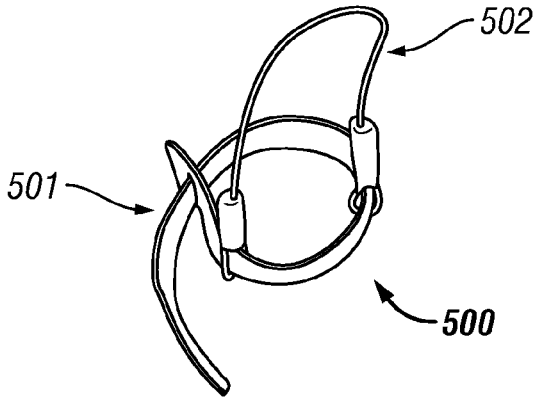
Figure 5C:
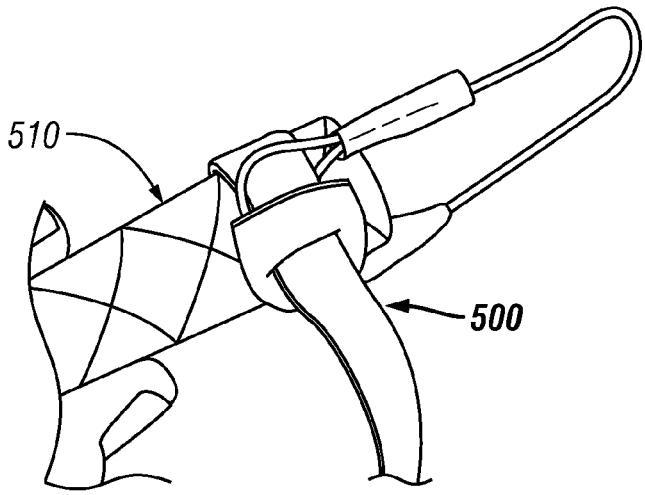

FIGS. 5A-5C show an attachment device for securing the elastic cord to the handle of a golf club in accordance with the present invention. FIG. 5A shows the device 500 unfolded. It is comprised of a Velcro strap 501 fed through loops ends of a wire 502. One end of the Velcro strap 501 has a small hole 511 through which the opposite end is fed, forming a loop as shown in FIG. 5B. This Velcro loop is then fit over the end of a golf club handle 510, as shown in FIG. 5C. The wire loop 502 forms the attachment point to which the elastic cord is connected.

The embodiments shown in FIGS. 4 and 5 are merely examples. Many configurations can be used to connect the elastic cord to either the user's hand/wrist or the golf club handle. The essential point is that resistance is applied close to where the hands grip the club handle in order to provide the correct line of pull.

Figure 6A:
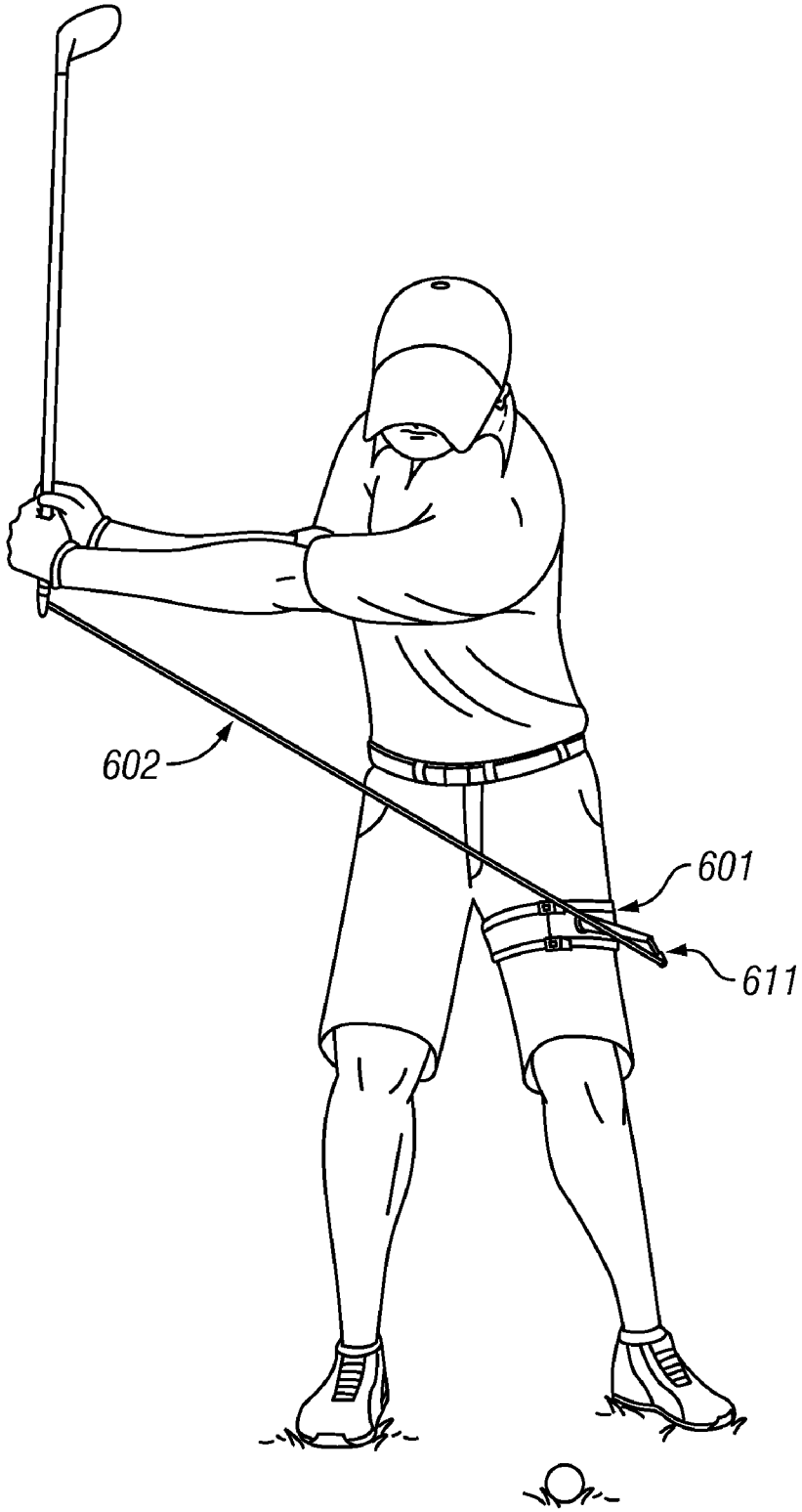
FIG. 6A shows a front view of the golf training device in use in accordance with the present invention.

FIG. 6A shows a front view of the golf training device in use in accordance with the present invention. The golf trainer 601 should be worn on the thigh that is contralateral to the backswing. Therefore, for a right handed golfer who will swing back to the right, the training device 601 is worn on the left thigh as shown in FIG. 6.

FIG. 6A illustrates how the elastic cord 602 is pulled across the body during a backswing. As explained above, the distal end of the elastic cord is attached to golf club handle or to a wrist band worn by the user. As the arms are drawn into the backswing, the elastic cord initially pulls the lever 611 on the golf trainer to the fully extended position where the lever stop prevents further motion (see FIG. 6C). From this point on, the remaining range of motion in the backswing is performed against the increasing resistance of the elastic cord 602.

Figure 6B:
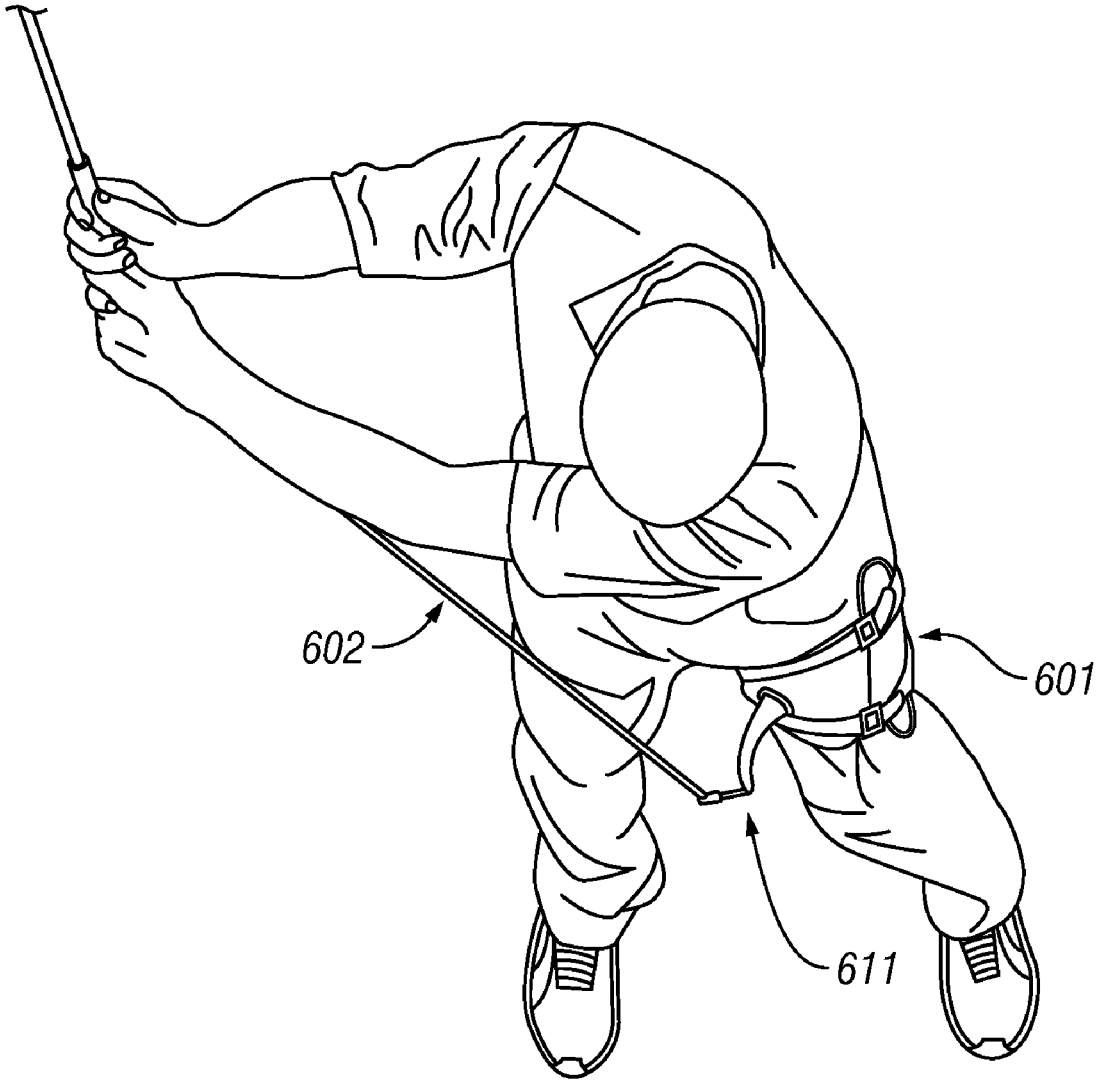
FIG. 6B shows an overhead view of a user performing a golf backswing with the golf training device in accordance with the present invention.

FIG. 6B shows an overhead view of a user performing a golf backswing with the golf training device in accordance with the present invention. As seen more clearly in this figure, the extended lever 611 provides the proper angle of pull for the elastic cord 602. Without this anchor point extended in front of the user's body, the elastic cord would merely stretch around the front of the body and restrict proper movement without applying the proper resistance at the proper angle in the backswing. In one embodiment of the invention, the length of the lever 611 can be adjusted in order to customize the angle of pull according to the height and limb length of the user.

Figure 6C:
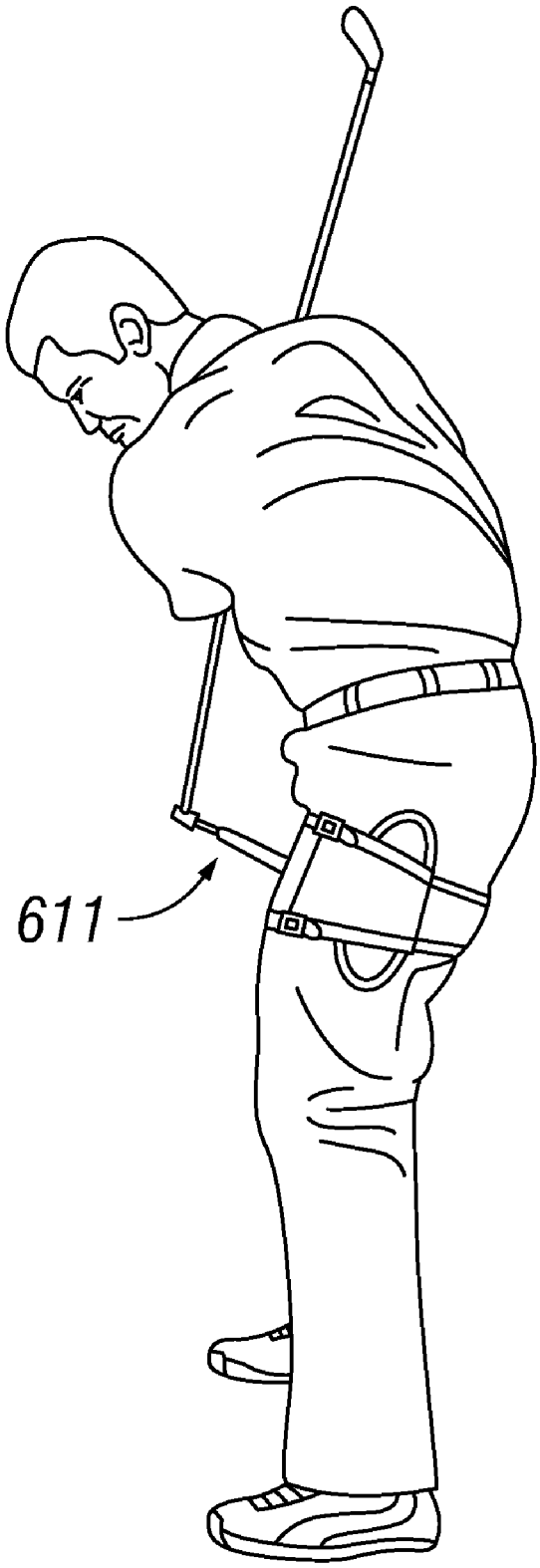
FIG. 6C is a side view of the golf trainer that more clearly shows how the lever of the device extends in front of the body to provide the proper angle of resistance during the backswing.

FIG. 6C is a side view of the golf trainer that more clearly shows how the lever 611 of the device extends in front of the body to provide the proper angle of resistance during the backswing.

The resistance provided by the elastic cord causes increased activation of muscles involved primarily in stabilizing the body during the backswing, including the gluteal muscles, hamstrings, abdominal muscles, erector spinae, latissimus dorsi, and the small paraspinal muscles that provide stability and proprioception to the spine, among others. Without the proper activation of these muscles and the stabilization they provide, the golfer cannot maintain correct posture and form, resulting in the golf club not following the proper return path to the ball during the forward swing. Lack of muscle activation and stabilization also results in the dissipation of potential energy stored in the muscles and tendons during the backswing, thereby preventing that potential energy from contributing to the power of the return swing.

The resistance provided by the elastic cord also reinforces proper technique by providing a braking mechanism to the backswing. The resistance exerted by an elastic cord necessarily increases in proportion to the length the cord is stretched. Therefore, as the user moves deeper into the backswing, the elastic cord provided increasing resistance until it arrests the backward movement of the club and user's arms. This aspect of the present invention is especially important for beginners who may have problems controlling the inertia of the golf club and are unable to stop the club's backward movement at the proper point in the backswing. In one embodiment of the present invention, the elastic cord can be changed out with another in order to adjust the amount of resistance. For example, a female golfer weighing 100 pounds would not require the same amount of resistance as a 200 pound man, and using too much resistance would in fact impair proper technique rather than improve it.

While the present invention is described above primarily for use in training a proper golf swing, it can in fact be applied to other sporting movements as well. A close biomechanical cousin of the golf swing is the two-hand backhand used in tennis. The training device of the present invention provides the proper line of pull to add resistance to the backswing of the backhand stroke. However, due to the lighter weight and shorter lever arm of a tennis racquet as compared to a golf club, a lighter-resistance elastic cord would be used. The present invention also has applications to sporting movements that do not involve a backswing, e.g., shooting in basketball (requiring two devices for each leg).

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. A sport training device, comprising:

(a) an arcuate frame worn on the thigh of a user;

(b) an adjustable belt or cuff coupled to said frame that secures the frame to the user's thigh;

(c) a lever with a distal end and coupled to said frame, wherein the distal end of the lever extends away from the frame in front of the user's body;

(d) an elastic cord with two ends, wherein one end is anchored to the distal end of said lever;

(e) an attachment means coupled to the other end of said elastic cord, wherein the attachment means allows the user's arms to extend the elastic cord, thereby providing resistance to the user's movement.

2. The sport training device according to claim 1, wherein the length of said lever is adjustable.

3. The sport training device according to claim 1, wherein said elastic cord is replaceable with other elastic cords of differing elastic resistance.

4. The sport training device according to claim 1, wherein said attachment means couples the elastic cord to a wrist strap.

5. The sport training device according to claim 1, wherein said attachment means couples the elastic cord to a glove.

6. The sport training device according to claim 1, wherein said attachment means couples the elastic cord to the handle of a sport implement.

7. The sport training device according to claim 6, wherein said sport implement is a golf club.

8. The sport training device according to claim 1, wherein the frame and lever are made of metal.

9. The sport training device according to claim 1, wherein the frame and lever are made of plastic.

10. The sport training device according to claim 1, wherein said lever rotates on a hinge coupled to said frame, wherein a lever stop allows the lever to fold against the frame in one direction and stops the lever in an extended position when the lever is pulled in the opposite direction by the elastic cord.

* * * * *